US008274240B2

(12) United States Patent
Salvestrini

(10) Patent No.: US 8,274,240 B2
(45) **Date of Patent: *Sep. 25, 2012**

(54) SWITCHING CIRCUIT HAVING DELAY FOR INRUSH CURRENT PROTECTION

(75) Inventor: Christopher James Salvestrini, Allentown, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 357 days.

This patent is subject to a terminal disclaimer.

(21) Appl. No.: 12/697,749

(22) Filed: Feb. 1, 2010

(65) Prior Publication Data

US 2011/0187332 A1 Aug. 4, 2011

(51) Int. Cl.
*H05B 37/02* (2006.01)

(52) U.S. Cl. ..... 315/291; 315/307; 315/362

(58) Field of Classification Search ..... 315/291, 315/294, 297, 307, 313, 362; 323/234, 239, 323/272, 324

See application file for complete search history.

(56) References Cited

U.S. PATENT DOCUMENTS

| | | | |
|---|---|---|---|
| 3,558,910 | A | 1/1971 | Dale et al. |
| 3,639,808 | A | 2/1972 | Ritzow |
| 3,982,137 | A | 9/1976 | Penrod |
| 4,025,820 | A | 5/1977 | Penrod |
| 4,251,845 | A | 2/1981 | Hancock |
| 4,349,748 | A | 9/1982 | Goldstein et al. |
| 4,389,691 | A | 6/1983 | Hancock |
| 4,709,188 | A | 11/1987 | Roberts |
| 4,772,809 | A | 9/1988 | Koga et al. |
| 4,788,415 | A | 11/1988 | Whipple, Jr. |
| 4,855,612 | A | 8/1989 | Koga et al. |
| 4,885,654 | A | 12/1989 | Budyko et al. |
| 5,309,068 | A | 5/1994 | Hakkarainen et al. |
| 5,633,540 | A | 5/1997 | Moan |
| 5,790,354 | A | 8/1998 | Altiti et al. |
| 6,486,616 | B1 * | 11/2002 | Liu et al. ..... 315/291 |

(Continued)

FOREIGN PATENT DOCUMENTS

CH 661148 A5 6/1987

(Continued)

OTHER PUBLICATIONS

U.S. Appl. No. 29/697,774, filed Feb. 1, 2010, Salvestrini et al.

(Continued)

*Primary Examiner* — Tung X Le

(74) *Attorney, Agent, or Firm* — Mark E. Rose; Philip N. Smith; Bridget L. McDonough

(57) ABSTRACT

A two-wire switching circuit can handle a large inrush current, but does not require a neutral connection or a heavy-duty mechanical switch or relay. The switching circuit comprises a mechanical air-gap switch and a controllably conductive device, which are coupled in series and are adapted to be coupled between an AC power source and an electrical load when the mechanical switch is in a first position. A first delay circuit is coupled in parallel with the controllably conductive device and in series with the mechanical air-gap switch. A latching circuit, which is responsive to the first delay circuit, is coupled to the controllably conductive device for controlling the controllably conductive device. The first delay circuit causes the latching circuit to control the controllably conductive device to be conductive after a first predetermined time after the mechanical air-gap switch changes to the first position.

25 Claims, 7 Drawing Sheets

U.S. PATENT DOCUMENTS

| | | | | |
|---|---|---|---|---|
| 7,110,225 | B1 | 9/2006 | Hick | |
| 7,312,585 | B2 * | 12/2007 | Wilhelm | 315/291 |
| 7,482,758 | B2 * | 1/2009 | Hua et al. | 315/119 |
| 2011/0037417 | A1 * | 2/2011 | Mix et al. | 315/307 |

FOREIGN PATENT DOCUMENTS

| | | | |
|---|---|---|---|
| DE | 3432025 | A1 | 3/1986 |
| DE | 19738989 | A1 | 3/1999 |
| GB | 2111751 | A | 7/1983 |
| WO | WO 87/05744 | A1 | 9/1987 |

OTHER PUBLICATIONS

European Patent Office, International Search Report and Written Opinion for International Patent Application No. PCT/US2001/023102, Nov. 18, 2011, 10 pages.

Anonymous, Inrush Current FAQ, Inrush Current Limiters—Ametherm, Mar. 28, 2009, XP002662912, retrieved from the Internet: URL:http//web.archive.org/web/20090328131101/http://www.ametherm.com/inrush-current/inrush-current-faq.html [retrieved on Nov. 4, 2011].

* cited by examiner

SWITCHING CIRCUIT HAVING DELAY FOR INRUSH CURRENT PROTECTION

BACKGROUND OF THE INVENTION

1. Field of the Invention

The present invention relates to current-switching circuits of the type used, for example, in fluorescent lighting control systems for selectively connecting one or more electronic ballasts to an alternating-current (AC) power source.

2. Description of the Related Art

Typically, gas discharge lamps, such as fluorescent lamps, must be driven by ballasts (such as electronic dimming ballasts) in order to illuminate. A common control method for dimming ballasts is "zero-to-ten-volt" (0-10V) control (which is sometimes referred to as 1-10V control). A 0-10V electronic dimming ballast receives power from an AC power source, with an external mechanical switch typically coupled between the AC power source and the 0-10V ballast to provide switched-hot voltage to the ballast. The 0-10V ballast controls the intensity of the connected lamp in response to a 0-10V control signal received from an external 0-10V control device. Often, the 0-10V control device is mounted in an electrical wallbox and comprises an intensity adjustment actuator, e.g., a slider control. The 0-10V control device regulates the direct-current (DC) voltage level of the 0-10V control signal provided to the ballast between a substantially low voltage (i.e., zero to one volt) to a maximum voltage (i.e., approximately ten volts) in response to an actuation of the intensity adjustment actuator.

When applying power to the electronic ballast, the ballast behaves as a capacitive load. Thus, when the mechanical switch is closed to turn on the fluorescent lamp, there is a large in-rush of current into the ballast, which quickly subsides as the ballast charges up to line voltage. This temporary current surge can be problematic as the number of electronic ballasts controlled by a mechanical switch increases. For example, in the case of a full 16-amp (steady-state) circuit of dimming ballasts, the in-rush current can approach 560 amps. Though short-lived, e.g., only a few line cycles or shorter, this level of surge can wreak havoc on the contacts of even a relatively large relay having a high current rating (e.g. 50 amps). The problem stems from the fact that each time a pair of contacts of the mechanical switch close or snap together, there is a tendency for the contacts to bounce apart. When this bouncing occurs during a large current surge, the intervening gas or air ionizes and arcing occurs. The arcing has the effect of blasting away the conductive coatings on the relay contacts which eventually causes the relay to fail, either due to erosion of the contact material, or, more commonly, due to welding of the contacts in the closed position.

Accordingly, prior art lighting control systems including 0-10V ballasts have required heavy-duty mechanical switches, which tend to be physically large and costly. Such mechanical switches are too large to fit in a single electrical wallbox and thus must be mounted in a separate enclosure than the 0-10V control device. An example of a prior art 0-10V control device that requires an externally-mounted relay is the Nova T-Star® 0-10V Control, model number NTFTV, manufactured by Lutron Electronics Co., Inc.

Other prior art switching circuits for ballasts have required advanced components and structures (such as microcontrollers and multiple relays per ballast circuit), and complex wiring topologies (such as requiring a neutral connection). An example of such a switching circuit is described in greater detail in commonly-assigned U.S. Pat. No. 5,309,068, issued May 3, 1994, entitled TWO RELAY SWITCHING CIRCUIT FOR FLUORESCENT LIGHTING CONTROLLER, and U.S. Pat. No. 5,633,540, issued May 27, 1999, entitled SURGE-RESISTANT RELAY SWITCHING CIRCUIT. The entire disclosures of both patents are hereby incorporated by reference.

Therefore, there is a need for a simple analog 0-10V load control device that fits in a single electrical wallbox and provides both the switched hot voltage and the 0-10V control signal to a 0-10V ballast. Further, there is a need for a simple two-wire switching circuit that can handle a large inrush current, but that does not require a neutral connection or a heavy-duty mechanical switch or relay.

SUMMARY OF THE INVENTION

According to an embodiment of the present invention, a two-wire switching circuit for controlling the power delivered from an AC power source to an electrical load comprises a mechanical air-gap switch, a turn-on delay circuit, a controllably conductive device, and a latching circuit. The mechanical air-gap switch is adapted to be coupled in series electrical connection between the AC power source and the electrical load. The turn-on delay circuit is adapted to be coupled in series electrical connection with the mechanical air-gap switch when the mechanical switch is in a first position, and is operable to conduct a control current through the mechanical air-gap switch when the mechanical switch is in the first position. The controllably conductive device has a control input and is coupled in parallel electrical connection with the turn-on delay circuit. The controllably conductive device is adapted to be coupled in series electrical connection between the AC power source and the electrical load when the mechanical switch is in the first position. The controllably conductive device is operable to change from a non-conductive state to a conductive state in response to the turn-on delay circuit after a first predetermined time from when the mechanical air-gap switch changes to the first position. The latching circuit is coupled to the turn-on delay circuit and the control input of the controllably conductive device. The latching circuit is responsive to the turn-on delay circuit to control the controllably conductive device to the conductive state after the first predetermined time from when the mechanical air-gap switch changes to the first position, such that the controllably conductive device stays latched in the conductive state. The mechanical air-gap switch and the controllably conductive device are operable to conduct the load current when the mechanical air-gap switch is in the first position. The switching circuit may further comprise a turn-off delay circuit operable to be coupled in series electrical connection between the AC power source and the electrical load when the mechanical air-gap switch is in a second position, such that the turn-off delay circuit is operable to cause the latching circuit to control the first controllably conductive device to the non-conductive state after a second predetermined time from when the mechanical air-gap switch changes to a second position.

The present invention also provides a load control device for controlling the power delivered from an AC power source to an electrical load. The load control device comprises a mechanical air-gap switch, an actuator, a turn-on delay circuit, a controllably conductive device, and a latching circuit. The mechanical air-gap switch is adapted to be coupled in series electrical connection between the AC power source and the electrical load, and the actuator is operable to actuate the mechanical air-gap switch. The turn-on delay circuit is adapted to be coupled in series electrical connection with the mechanical air-gap switch when the mechanical switch is in a first position, such that the turn-on delay circuit is operable to conduct a control current through the mechanical air-gap switch when the mechanical switch is in the first position. The controllably conductive device has a control input and is coupled in parallel electrical connection with the turn-on delay circuit. The controllably conductive device is adapted to be coupled in series electrical connection between the AC power source and the electrical load when the mechanical switch is in the first position. The controllably conductive device is operable to change from a non-conductive state to a conductive state in response to the turn-on delay circuit after a first predetermined time from when the mechanical air-gap switch changes to the first position. The latching circuit is coupled to the turn-on delay circuit and the control input of the controllably conductive device. The latching circuit is responsive to the first turn-on delay circuit to control the controllably conductive device to the conductive state after the first predetermined time from when the mechanical air-gap switch changes to the first position, such that the controllably conductive device stays latched in the conductive state. The mechanical air-gap switch and the controllably conductive device are operable to conduct the load current when in the first position.

In addition, a method for controlling the power delivered to an electrical load from an AC power source is also described herein. The method comprises: (1) switching a mechanical switch to a first position; (2) beginning to conduct a control current through the mechanical switch in response to switching the mechanical switch to the first position; (3) coupling a first controllably conductive device in series electrical connection between the AC power source and the electrical load when the mechanical switch is in the first position; (4) controlling the first controllably conductive device to a conductive state after a first predetermined time from the beginning of the conduction of the control current through the mechanical switch; (5) subsequently conducting a load current through the mechanical switch; and (6) latching the first controllably conductive device in the conductive state such that the first controllably conductive device is subsequently maintained conductive each half-cycle of the AC power source.

Other features and advantages of the present invention will become apparent from the following description of the invention that refers to the accompanying drawings.

BRIEF DESCRIPTION OF THE DRAWINGS

The invention will now be described in greater detail in the following detailed description with reference to the drawings in which.

DETAILED DESCRIPTION OF THE INVENTION

Figure 1:
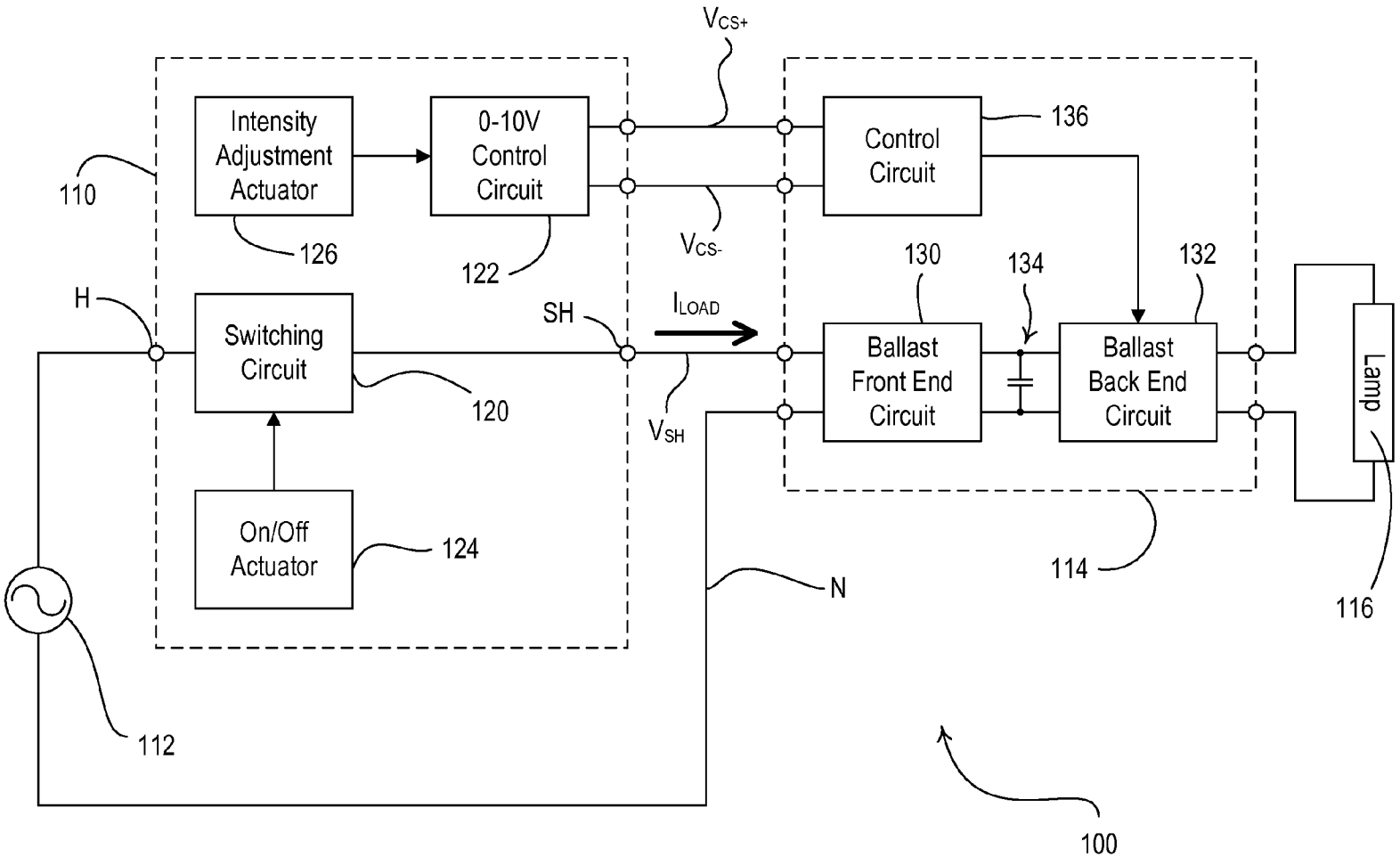
FIG. 1 is a simplified block diagram of a lighting control system including a 0-10V control device according to the present invention.

The foregoing summary, as well as the following detailed description of the preferred embodiments, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

FIG. 1 is a simplified block diagram of a lighting control system 100 including a 0-10V control device 110 according to the present invention. The 0-10V control device 110 is coupled in series between an AC power source 112 and a 0-10V electronic dimming ballast 114 and is operable to controllably conduct a load current $I_{LOAD}$ from the AC power source to the ballast. The 0-10V ballast 114 controls the intensity of a fluorescent lamp 116 in response to a 0-10V control signal (i.e., an intensity control signal) provided by the 0-10V control device 110.

The 0-10V control device 110 comprises both a switching circuit 120 and a 0-10V control circuit 122. The 0-10V control device 110 may be mounted in a single electrical wallbox. The switching circuit 120 comprises a "two-wire" switching circuit, i.e., the switching circuit does not require a connection to the neutral connection N of the AC power source 112. The switching circuit 120 is coupled in series between a hot terminal H of the AC power source 112 and a switched hot terminal SH of the 0-10V ballast 114. The neutral connection N of the AC power source 112 is connected to the ballast 114, but is not connected to the 0-10V control device 110 as previously mentioned. The switching circuit 120 selectively conducts the load current $I_{LOAD}$ from the AC power source 112 to the ballast 114 in response to actuations of an on/off actuator 124 (e.g., a toggle switch) to generate a switched-hot voltage $V_{SH}$ at the switched hot terminal SH. Alternatively, the on/off actuator 124 may comprise a mechanical switch that is actuated by a slider control, for example, when the slider control reaches a minimum position (i.e., a "slide-to-off" slider control).

The 0-10V control circuit 122 provides the 0-10V control signal to the ballast 114 across positive and negative 0-10V control wires ($V_{CS+}$ and $V_{CS-}$). The 0-10V control circuit 122 varies the DC magnitude of the 0-10V control signal in response to an intensity adjustment actuator 126, e.g., a slider control. When the switching circuit 120 is conductive (i.e., is conducting the load current $I_{LOAD}$ to the ballast 114), the lamp 116 is energized and the ballast is operable to control the intensity of the lamp in response to the magnitude of the 0-10V control signal. When the switching circuit 120 is non-conductive (i.e., is not conducting the load current $I_{LOAD}$ to the ballast 114), the ballast 114 is not energized and thus the lamp 116 is off.

The ballast 114 comprises a front end circuit 130 and a back end circuit 132. The front end circuit 130 includes a rectifier (not shown) for receiving the AC mains line voltage (via the switched-hot voltage $V_{SH}$) and generating a DC bus voltage across a bus capacitor 134. The front end circuit 130 of ballast 114 also may include a boost circuit (not shown) for boosting the magnitude of the DC bus voltage above the peak of the line voltage and for improving the total harmonic distortion (THD) and power factor of the input current to the ballast. The back end circuit 132 includes an inverter circuit (not shown) for converting the DC bus voltage to a high-frequency AC voltage and an output stage (not shown) comprising a resonant tank circuit (not shown) for coupling the high-frequency AC voltage to the electrodes of the lamp 116. The ballast 114 further comprises a control circuit 136, which receives the 0-10V control signal and controls the back end circuit 132 (specifically, the inverter circuit) to control the intensity of the lamp 116 in response to the magnitude of the 0-10V control signal. The 0-10V control scheme is well known in the art and will not be described in greater detail herein. Examples of electronic dimming ballasts are described in greater detail in commonly-assigned U.S. Pat. No. 6,674,248, issued Jan. 6, 2004, entitled ELECTRONIC BALLAST, and U.S. Pat. No. 7,528,554, issued May 5, 2009, entitled ELECTRONIC BALLAST HAVING A BOOST CONVERTER WITH AN IMPROVED RANGE OF OUTPUT POWER. The entire disclosures of both patents are hereby incorporated by reference.

Figure 2:
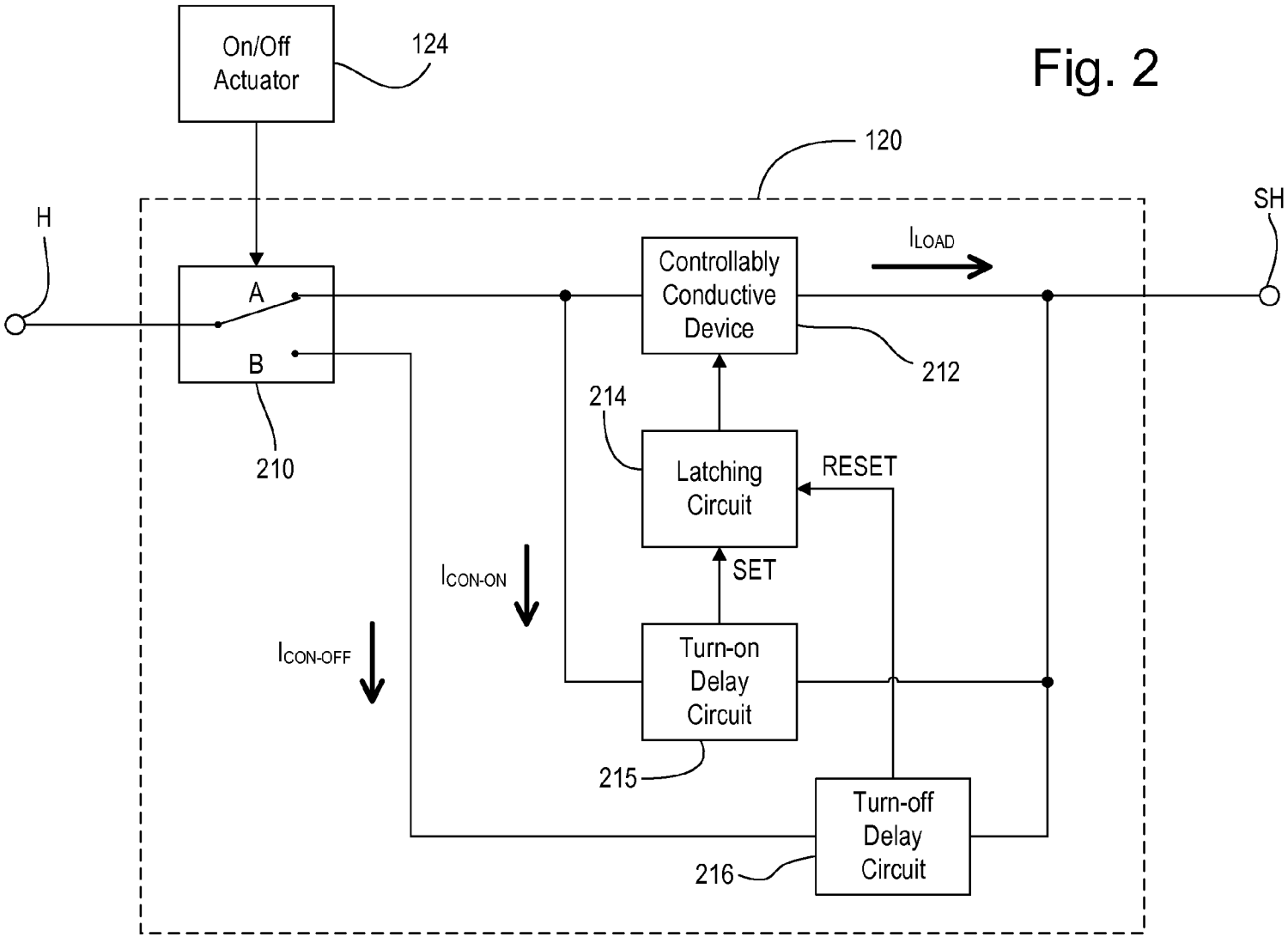
FIG. 2 is a simplified block diagram of a switching circuit of the 0-10V control device of FIG. 1 according to a first embodiment the present invention.

FIG. 2 is a simplified block diagram of the switching circuit 120 of the 0-10V control device 110 according to a first embodiment the present invention. The switching circuit 120 comprises a mechanical single-pole double-throw (SPDT) switch 210, which is switched between a position A and a position B by the on/off actuator 124. The switching circuit 120 operates such that the ballast 114 and the lamp 116 will be on (i.e., energized) when the SPDT switch 210 is in position A, and the ballast and the lamp will be off when the switch 210 is in position B. The switching circuit 120 comprises a controllably conductive device 212, which is coupled in series electrical connection between the AC power source 112 and the ballast 114 when the SPDT switch 210 is in position A. The controllably conductive device 210 may comprise a relay or any type of suitable bidirectional semiconductor switch, such as a triac, two silicon-controlled rectifiers (SCR) in anti-parallel connection, a field effect transistor (FET) or an insulated gate bipolar transistor (IGBT) in a full-wave rectifier bridge, two FETs in anti-series connection, or two IGBTs in anti-series connection. A latching circuit 214 provides a control signal to a control input of the controllably conductive device 212. The latching circuit 214 includes a SET input and a RESET input and is operable to maintain the control signal at the control input of the controllably conductive device 212 in response to the SET and RESET inputs. The controllably conductive device 210 may be controlled between a conductive state (in which the load current $I_{LOAD}$ is conducted to the ballast 114) and a non-conductive state (in which the load current $I_{LOAD}$ is not conducted to the ballast).

When the SPDT switch 210 is changed from position B to position A (i.e., the on/off actuator 124 has been actuated to turn the lamp 116 on), a turn-on delay control current $I_{CON\text{-}ON}$ flows through a turn-on delay circuit 215. The turn-on delay control current $I_{CON\text{-}ON}$ has an appropriately small magnitude (e.g., approximately 5 mA and at least less than approximately 10 mA), such that no arcing occurs at the contacts of the SPDT switch 210 as the switch bounces. After a predetermined turn-on delay time$_{DELAY\text{-}ON}$ from when the SPDT switch 210 changes to position A (i.e., after the switch 210 has stopped bouncing), the turn-on delay circuit 215 sets the latching circuit 214 such that the appropriate control signal is provided to (e.g., a gate current is conducted through) the control input of the controllably conductive device 212. Accordingly, the controllably conductive device 212 begins to conduct current from the AC source 112 to the ballast 114. At this time, the ballast 114 will draw the large inrush current and the lamp 116 will ignite. Since the SPDT switch 210 is fully closed (and not bouncing) at this time, no arcing occurs at the contacts of the switch. The latching circuit 214 maintains the controllably conductive device 212 conductive and the controllably conductive device conducts the load current $I_{LOAD}$ to the ballast 114 until the SPDT switch 210 is changed to position B and a turn-off delay circuit 216 resets the latching circuit.

When the SPDT switch 210 is changed from position A to position B, the switching circuit 120 stops conducting the load current $I_{LOAD}$ to the ballast 114. At this time, a turn-off delay control current $I_{CON\text{-}OFF}$ begins to flow through the turn-off delay circuit 216. As previously mentioned, the turn-off delay control current $I_{CON\text{-}OFF}$ also has a small magnitude (i.e., approximately 5 mA) such that no arcing occurs at the contacts of the SPDT switch 210. After a predetermined turn-off delay time$_{DELAY\text{-}OFF}$, the turn-off delay circuit 216 resets the latching circuit 214 such that the controllably conductive device 212 is rendered non-conductive.

Figure 3:
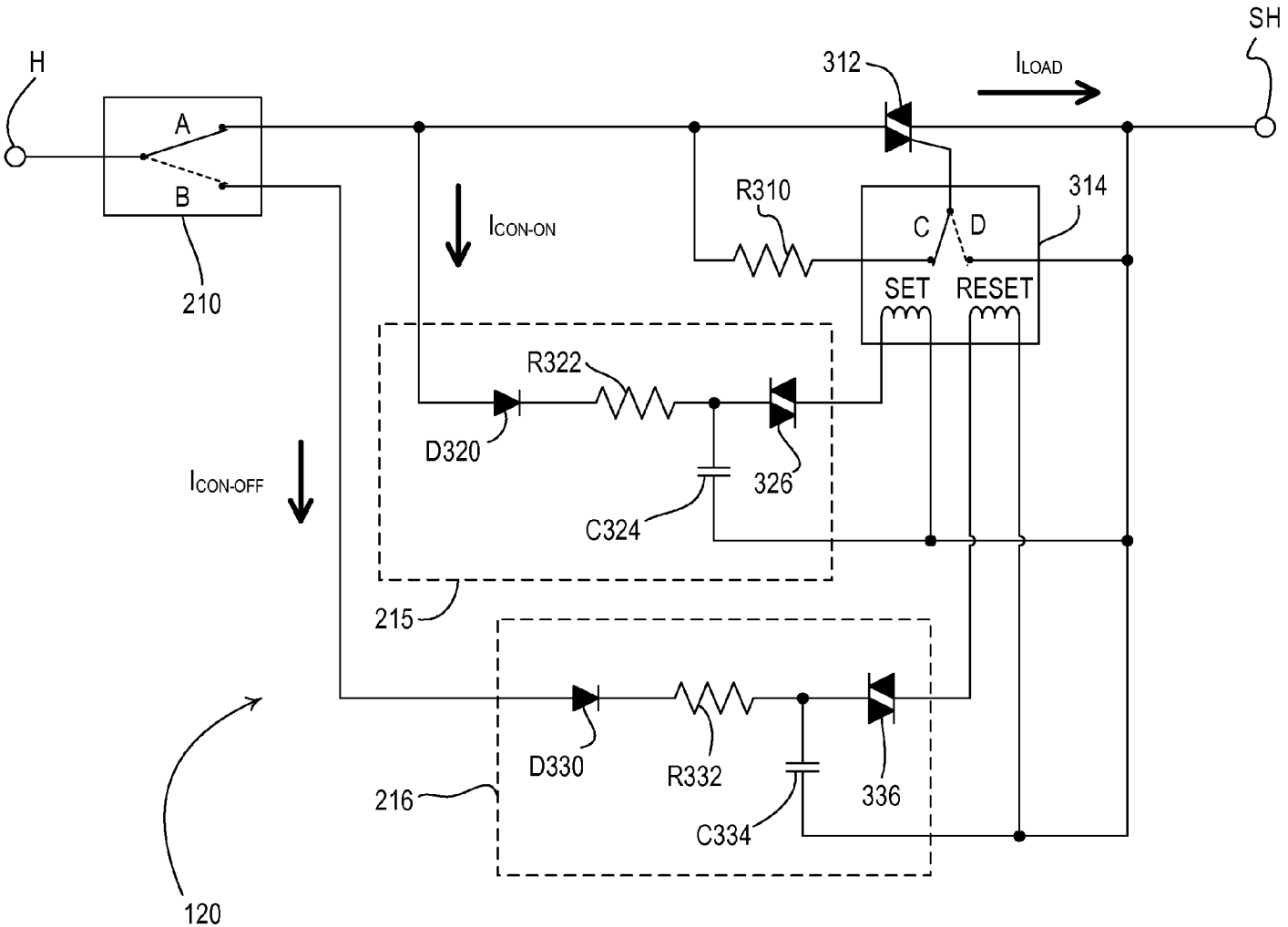
FIG. 3 is a simplified schematic diagram of the switching circuit of FIG. 2 according to the first embodiment of the present invention.

FIG. 3 is a simplified schematic diagram of the switching circuit 120 according to the first embodiment of the present invention. As shown in FIG. 3, the controllably conductive device 212 is implemented as a triac 312 and the latching circuit 214 is implemented as a single-pole double-throw (SPDT) latching relay 314. The latching relay 314 has a movable contact, which is connected to the control input (i.e., the gate) of the triac 312, and two fixed contacts. The latching relay 314 further comprises a SET coil and a RESET coil. When current flows through the SET coil, the latching relay 314 switches to position C, i.e., the latching relay is set. At this time, a gate resistor R310 is coupled in series between the hot terminal H and the control input of the triac 312 (when the SPDT switch 210 is in position A) to limit the magnitude of the gate current through the control input. For example, the gate resistor R310 may have a resistance of approximately 440Ω. When current is conducted through the RESET coil, the movable contact of the latching relay 314 moves to position D (i.e., the latching relay is reset), and the control input of the triac 312 is connected to the switched hot terminal SH such that the triac stops conducting.

The turn-on delay circuit 215 comprises a diode D320, a timing circuit (e.g., a resistor R322 and a capacitor C324), and a triggering device (e.g., a diac 326). The turn-on delay control current $I_{CON\text{-}ON}$ flows through the diode D320 and the resistor R322 to allow the capacitor C324 to charge. When the voltage across the capacitor C324 exceeds a break-over voltage $V_{BR1}$ of the diac 326, the diac conducts a pulse of current through the SET coil of the latching relay 314. Accordingly, the latching relay 314 changes from position D to position C, which in turn causes the triac 312 to become conductive. The triac 314 stops conducting at approximately the end of each half-cycle when the magnitude of the load current $I_{LOAD}$ through the triac drops to approximately zero amps. However, since the latching relay 314 remains in position C, the triac 312 continues to fire each half-cycle, for example, 100-150 μsec after the beginning of each half-cycle (i.e., with a phase angle of approximately 2° to 3°). Accordingly, substantially all of the AC voltage of the AC power source 112 is provided to the ballast 114 (i.e., greater than 99% of the AC voltage). The triac 314 stops firing each half-cycle when the turn-off delay circuit 216 resets the latching relay 314.

The length of the turn-on delay time$_{DELAY\text{-}ON}$ (i.e., the time from when the SPDT switch 210 moves to position A to when the latching relay 314 moves to position C) is longer than the time required for the contacts of the switch 210 to stop bouncing. The length of the turn-on delay time$_{DELAY\text{-}ON}$ is determined by the resistance of the resistor R322, the capacitance of the capacitor C324, and the break-over voltage $V_{BR1}$ of the diac 326 (in addition to the fact that the diode D320 only conducts during the positive half-cycles). For example, the resistance of the resistor R322 may be approximately 60 kΩ, the capacitance of the capacitor C324 may be approximately 10 μF, and the break-over voltage of the diac 326 may be approximately 30 volts, such that the length of the turn-on delay time$_{DELAY\text{-}ON}$ may be approximately 100 msec.

The turn-off delay circuit 216 has a similar structure to the turn-on delay circuit 215 and comprises a diode D330, a resistor R332, a capacitor C334, and a diac 336. When the SPDT switch 210 is moved to position B, the switching circuit 120 stops conducting the load current $I_{LOAD}$ and the turn-off delay control current $I_{CON-OFF}$ begins flowing through the diode D330, the resistor R332, and the capacitor C334. When the voltage across the capacitor C334 exceeds a break-over voltage $V_{BR2}$ of the diac, the diac 336 fires and a pulse of current is conducted through the RESET coil of the latching relay 314. Accordingly, the latching relay 314 will change from position C to position D and the control input of the triac 312 becomes coupled to the switched hot terminal SH such that the triac is no longer rendered conductive each half-cycle.

The length of the turn-off delay time$_{DELAY-OFF}$ (i.e., the time from when the SPDT switch 210 moves to position B to when the latching relay 314 moves to position D) is determined by the resistance of the resistor R332, the capacitance of the capacitor C334, and the break-over voltage $V_{BR2}$ of the diac 336 (in addition to the fact that the diode D330 only conducts during the positive half-cycles). For example, the resistance of the resistor R332 may be approximately 60 kΩ, the capacitance of the capacitor C334 may be approximately 10 μF, and the break-over voltage $V_{BR2}$ of the diac 336 may be approximately 30 volts, such that the length of the turn-off delay time$_{DELAY-OF}$ may be approximately 100 msec.

Figure 4:
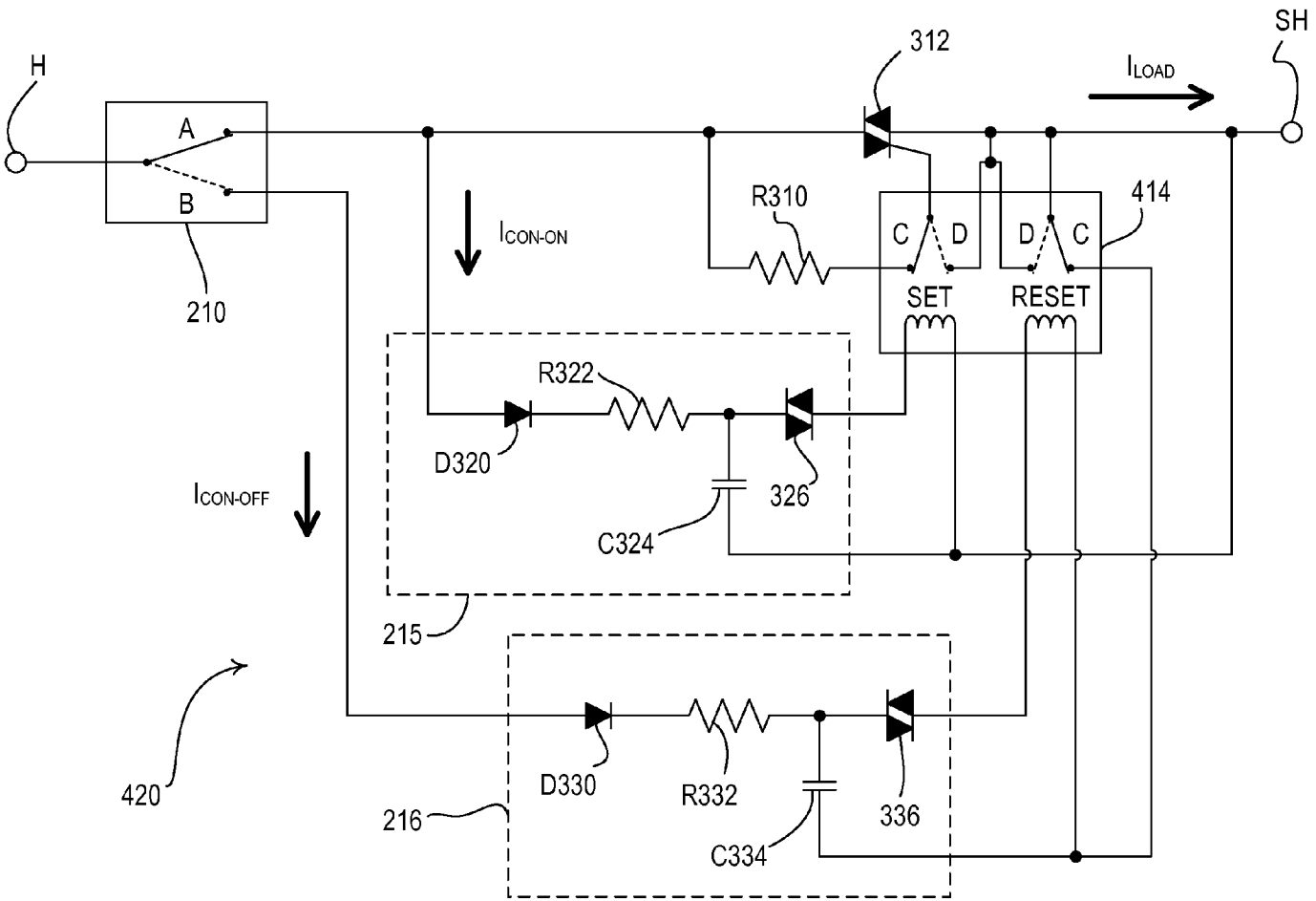
FIG. 4 is a simplified schematic diagram of a switching circuit according to a second.

FIG. 4 is a simplified schematic diagram of a switching circuit 420 according to a second embodiment of the present invention. The switching circuit 420 comprises a double-pole double-throw (DPDT) latching relay 414 and provides a true air-gap break between the AC power source 112 and the ballast 114. When the mechanical SPDT switch 210 is in position B, there is no electrically conductive path (i.e., the air-gap break is provided) between the AC power source 112 and the ballast 114.

When the SPDT switch 210 is in position A, the turn-on delay circuit 215 sets the latching relay 414, which switches to position C. Accordingly, the triac 312 fires each half-cycle and conducts the load current $I_{LOAD}$ to the ballast 114. When the SPDT switch 210 changes to position B, the turn-off delay circuit 216 is coupled between the AC power source 112 and the ballast 114 since the DPDT latching relay 414 is in position C. The capacitor C334 charges and the diac 336 fires, thus, resetting the latching relay 414. The latching relay 414 switches to position D, such that the control input of the triac 312 is coupled to the switched hot terminal SH (i.e., the triac will not be rendered conductive the next half-cycle) and the turn-off delay circuit 216 is no longer coupled between the AC power source 112 and the ballast 114. Accordingly, because the SPDT switch 210 is in position B and the DPDT latching relay 314 is in position D, there is a true air-gap break between the AC power source 112 and the ballast 114.

Figure 5:
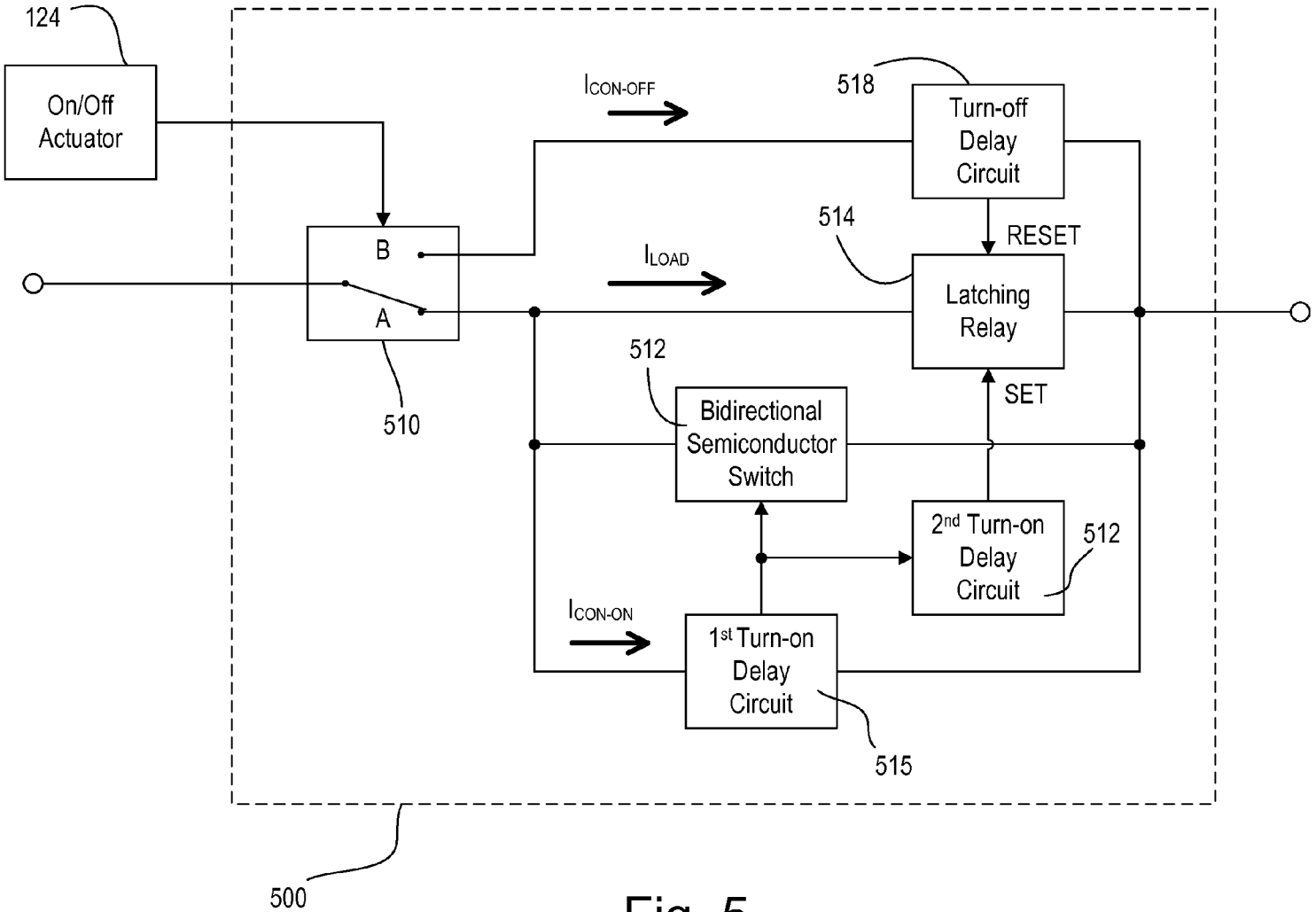
FIG. 5 is a simplified block diagram of a switching circuit according to a third embodiment.

FIG. 5 is a simplified block diagram of a switching circuit 500 of the 0-10V control device 110 according to a third embodiment. The switching circuit 500 comprises, for example, a mechanical SPDT switch 510, which is mechanically coupled to the on/off actuator 124, such that the on/off actuator is operable to actuate the SPDT switch 510 to switch the SPDT switch between a position A and a position B. The SPDT switch 510 operates such that the ballast 114 and the lamp 116 will be on, i.e., energized, when the switch 510 is in position A, and the ballast and the lamp will be off when the switch 510 is in position B. The SPDT switch 510 may alternatively comprise any suitable mechanical switching circuit, for example, two separate single-pole single-throw (SPST) switches that are both controlled by the on/off actuator 124.

The switching circuit 500 further comprises a first controllably conductive device (e.g., a bidirectional semiconductor switch 512) and a second controllably conductive device (e.g., a latching relay 514), which are coupled in parallel with each other. The bidirectional semiconductor switch 512 may comprise any suitable type of bidirectional semiconductor switch, such as a triac, two silicon-controlled rectifiers (SCRs) in anti-parallel connection, a field effect transistor (FET) or an insulated gate bipolar transistor (IGBT) in a full-wave rectifier bridge, two FETs in anti-series connection, or two IGBTs in anti-series connection. When the SPDT switch 510 is in position A, the parallel combination of the bidirectional semiconductor switch 512 and the latching relay 514 is coupled in series electrical connection between the AC power source 112 and the ballast 114. The bidirectional semiconductor switch 512 and the latching relay 514 may each be controlled between a conductive state and a non-conductive state.

When the SPDT switch 510 is moved to position A (i.e., the on/off actuator 124 has been actuated to turn the lamp 116 on), the bidirectional semiconductor switch 512 is rendered conductive (i.e., changed from the non-conductive state to the conductive state) before the latching relay 514 is rendered conductive (i.e., changed from the non-conductive state to the conductive state). This allows the bidirectional semiconductor switch 512 to conduct the inrush current of the ballast 114. After the bidirectional semiconductor switch 512 is rendered conductive, the latching relay 514 is controlled to the conductive state in response to a SET input. Accordingly, the latching relay 514 conducts the load current $I_{LOAD}$ from the AC power source 112 to the ballast 114 after the inrush current has subsided. Since the latching relay 514 remains conductive independent of the magnitude of the load current $I_{LOAD}$ flowing through the relay, the switching circuit 500 is able to supply current to ballasts that draw a low steady-state current. The latching relay 514 is controlled to the non-conductive state in response to a RESET input, such that the switching circuit 500 stops conducting the load current $I_{LOAD}$ to the ballast 114.

The switching circuit 500 comprises two turn-on delay circuits (i.e., a first turn-on delay circuit 515 and a second turn-on delay circuit 516) and a turn-off delay circuit 518. When the SPDT switch 510 changes from position B to position A, a turn-on delay control current $I_{CON-ON}$ flows through the first turn-on delay circuit 515. The turn-on delay control current $I_{CON-ON}$ has an appropriately small magnitude such that no arcing occurs at the contacts of the SPDT switch 510 as the switch bounces. After a first turn-on delay time$_{DELAY-ON1}$ from when the SPDT switch 510 changes from position B to position A (i.e., after the contacts of the SPDT switch have stopped bouncing), the first turn-on delay circuit 515 renders the bidirectional semiconductor switch 512 conductive, such that the ballast 114 conducts the large inrush current through the bidirectional semiconductor switch. Since the SPDT switch 510 is fully closed (and not bouncing) at this time, no arcing occurs at the contacts of the switch.

The second turn-on delay circuit 516 is responsive to the first turn-on delay circuit 515 to cause the latching relay 514 to become conductive, i.e., to set the latching relay, at the end of a second turn-on delay time $t_{DELAY-ON2}$ after the bidirectional semiconductor switch 512 is rendered conductive. The voltage at the output of the first turn-on delay circuit 515 begins to decrease with respect to time after the bidirectional semiconductor switch 512 is rendered conductive. When the voltage at the output of the first turn-on delay circuit 515 drops below a predetermined threshold voltage $V_{TH}$, the second turn-on delay circuit energizes the SET coil of the latching relay 514, such that the latching relay conducts current from the AC power source 112 to the ballast 114. Thus, the latching relay 514 is rendered conductive at a total turn-on delay time $t_{DELAY\text{-}TOTAL}$ (i.e., $t_{DELAY\text{-}ON1}+t_{DELAY\text{-}ON2}$) after the SPDT switch 510 is changed to position A. The total turn-on delay time $t_{DELAY\text{-}TOTAL}$ is longer than the time required for the contacts of the SPDT switch 510 to stop bouncing. The latching relay 514 is maintained in the conductive state independent of the magnitude of the load current $I_{LOAD}$ conducted through the ballast 114 until the SPDT switch 510 is changed to position B and the turn-off delay circuit 516 resets the latching relay 514.

When the SPDT switch 510 is changed from position A to position B, the switching circuit 500 stops conducting the load current $I_{LOAD}$ to the ballast 114. At this time, a turn-off delay control current $I_{CON\text{-}OFF}$ begins to flow through the turn-off delay circuit 518. The turn-off delay control current $I_{CON\text{-}OFF}$ has an appropriately small magnitude (e.g., approximately 5 mA and at least less than approximately 10 mA), such that no arcing occurs at the contacts of the SPDT switch 510. After a turn-off delay time $t_{DELAY\text{-}OFF}$ from when the SPDT switch is changed from position A to position B, the turn-off delay circuit 518 resets the latching relay 514.

Figure 6A:
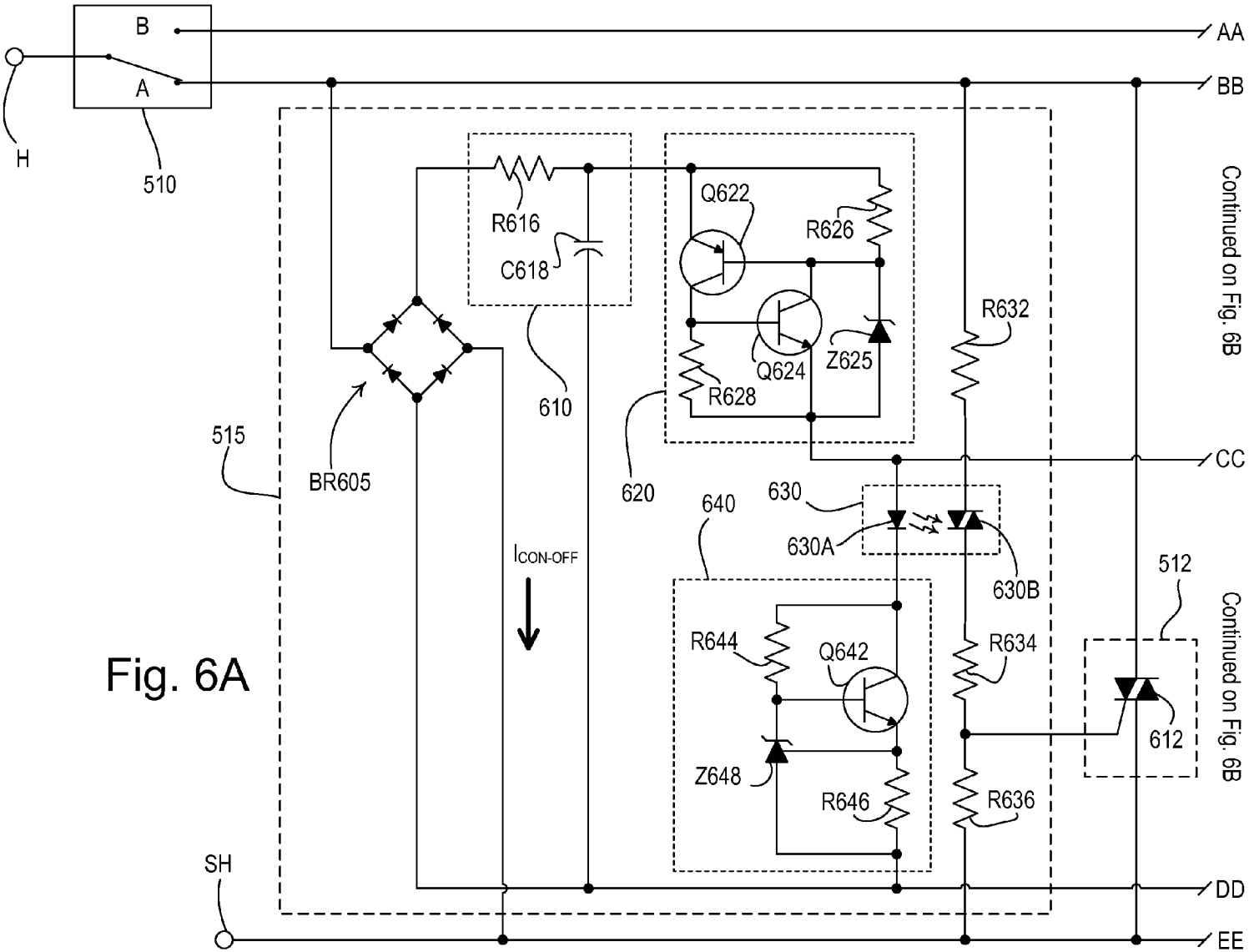
FIGS. 6A and 6B show a simplified schematic diagram of the switching circuit of FIG. 5.
Figure 6B:
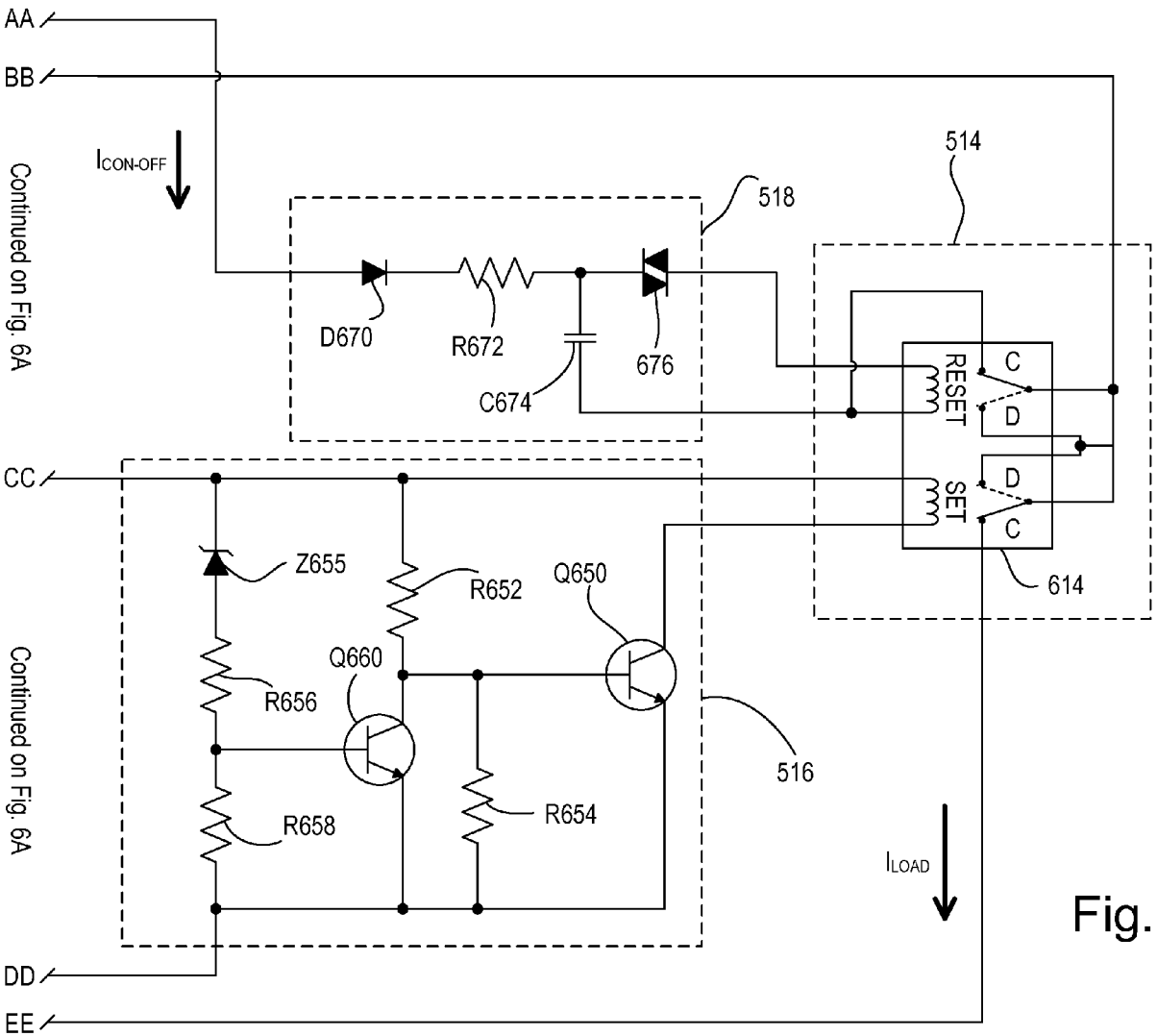

FIGS. 6A and 6B show a simplified schematic diagram of the switching circuit 500 according to the third embodiment of the present invention. As shown in FIGS. 6A and 6B, the bidirectional semiconductor switch 512 is implemented as a triac 612 and the latching relay 514 is implemented as a double-pole double-throw (DPDT) latching relay 614. When the SPDT switch 510 is in position A, the parallel combination of the triac 612 and the DPDT latching relay 614 is coupled between the hot terminal H and the switched-hot terminal SH, such that the triac and the DPDT latching relay are operable to control the power delivered to the ballast 114. Further, when the SPDT switch 510 is in position B, the DPDT relay 614 is in position D and a true air-gap break is provided between the source and the ballast 114, such that there is no electrically conductive path between the AC power source 112 and the ballast and the switching circuit 500 does not conduct the load current $I_{LOAD}$ to the ballast.

The first turn-on delay circuit 515 comprises a full-wave bridge rectifier BR605, which is coupled from the hot terminal H to the switched-hot terminal SH when the SPDT switch 510 is in position A. The DC terminals of the rectifier BR610 are coupled across a timing circuit 610 including a resistor R616 and a capacitor C618. A triggering circuit 620 is coupled to the junction of the resistor R616 and the capacitor C618. The triggering circuit 620 comprises a PNP transistor Q622, an NPN transistor Q624, a zener diode Z625, and two resistors R626, R628 (e.g., each have a resistance of approximately 10 kΩ). The triggering circuit 620 is coupled to the gate of the triac 612 via an optocoupler 630 and resistors R632, R634, R636 (e.g., having resistances of approximately 220Ω, 220Ω, and 100Ω, respectively). A current-limit circuit 640 is coupled in series with the triggering circuit 620 and a photodiode 630A of the optocoupler 630. When the voltage across the capacitor C618 exceeds a break-over voltage $V_{BR3}$ of the triggering circuit 620, the triggering circuit "fires", i.e., the triggering circuit conducts a pulse of current through photodiode 630A of the optocoupler 630 and the current-limit circuit 640.

When the SPDT switch 510 is moved to position A, the turn-on delay control current $I_{CON\text{-}ON}$ flows through the rectifier BR610 and the resistor R616 to allow the capacitor C618 to charge. The zener diode Z625 of the triggering circuit 620 begins conducting current when the voltage across the capacitor C618 (i.e., across the triggering circuit 620) exceeds a break-over voltage $V_{Z1}$ of the zener diode Z625 (e.g., approximately 30V). The transistor Q622 is rendered conductive when the voltage across the resistor R626 reaches the required base-emitter voltage of the transistor Q622. A voltage is then produced across the resistor R628, which causes the transistor Q624 to begin conducting. This essentially shorts out the zener diode Z625 such that the zener diode stops conducting, and the voltage across the triggering circuit 620 falls to approximately zero to one volt. The break-over voltage $V_{BR3}$ of the triggering circuit 620 is approximately equal to the break-over voltage $V_{Z1}$ of the zener diode Z625.

The resistance of the resistor R616, the capacitance of the capacitor R618, and the break-over voltage $V_{Z1}$ of the zener diode Z625 determine the length of the first turn-on delay time $t_{DELAY\text{-}ON1}$, i.e., the time from when the SPDT switch 510 moves to position A to when the triac 612 is rendered conductive. For example, the resistance of the resistor R616 may be approximately 64 kΩ and the capacitance of the capacitor C618 may be approximately 47 μF, such that length of the first turn-on delay time $t_{DELAY1\text{-}ON1}$ may be approximately 150 msec, but may range from 125 msec to 175 msec.

When the triggering circuit 620 fires, the pulse of current flows from the capacitor C618 through the triggering circuit 620 and the photodiode 630A of the optocoupler 630. When the photodiode 630A conducts the pulse of current, a photosensitive triac 630 of the optocoupler 630 conducts to allow current to flow into the gate of the triac 612 in the positive half-cycles, and out of the gate in the negative half-cycles. Accordingly, the triac 612 will be rendered conductive and will conduct the large inrush current to the ballast 114.

The current-limit circuit 640 controls the magnitude of the pulse of current that flows through the triggering circuit 620 and the photodiode 630A of the optocoupler 630 when the triggering circuit 620 fires. The current-limit circuit 640 comprises an NPN bipolar junction transistor Q642, two resistors R644, R646, and a shunt regulator zener diode Z648. When the triggering circuit 620 begins to conduct the pulse of current, current flows through the resistor R644 and into the base of the transistor Q642, thus rendering the transistor Q642 conductive. Accordingly, the transistor Q642 conducts the pulse of current from the triggering circuit 620 through the resistor R646. The shunt regulator zener diode Z648 has a shunt connection coupled to the emitter of the transistor Q642 to limit the magnitude of the pulse of current. For example, the shunt diode Z648 may have a reference voltage of approximately 1.24V, the resistor R644 may have a resistance of approximately 20 kΩ and the resistor R646 may have a resistance of approximately 511Ω, such that the magnitude of the pulse of current may be limited to approximately 2.4 mA.

The second turn-on delay circuit 516 of the switching circuit 500 is responsive to the voltage produced at the junction of the triggering circuit 620 and the photodiode 630A of the optocoupler 630 of the first turn-on delay circuit 515. The second turn-on delay circuit 516 comprises an NPN bipolar junction transistor Q650, which is coupled to the SET coil of the DPDT latching relay 614 for causing the latching relay to switch to position C to thus conduct the load current $I_{LOAD}$ from the source 112 to the ballast 114. The base of the transistor Q650 is coupled to the junction of the triggering circuit 620 and the photodiode 330A of the optocoupler 630 of the first turn-on delay circuit 515 through a resistor R652 (e.g., having a resistance of approximately 56.2 kΩ). A resistor R654 is coupled across the base-emitter junction of the transistor Q650 and has, for example, a resistance of approximately 56.2 kΩ. Before the triggering circuit 620 has fired, the voltage across the second turn-on delay circuit 516 is approximately zero volts and the transistor Q650 is non-conductive.

The second turn-on delay circuit 516 comprises a zener diode Z655 coupled in series with two resistors R656, R658 (e.g., having resistances of approximately 5.11 kΩ and 56.2 kΩ, respectively). Since the voltage across the triggering circuit 620 of the first turn-on delay circuit 515 is approximately zero volts when the triggering circuit fires, the voltage across the second turn-on delay circuit 516 will be approximately equal to the voltage across the capacitor C618, i.e., 30V. The zener diode Z655 has, for example, a break-over voltage $V_{Z2}$ of approximately 18V, such that the zener diode begins to conduct current through the two resistors R656, R658 after the triggering circuit 620 fires. A voltage produced across the resistor R658 causes an NPN bipolar junction transistor Q660 to conduct, thus pulling the base of the transistor Q650 towards zero volts. Therefore, the transistor Q650 is prevented from conducting current and setting the SPDT latching relay 614 immediately after the triggering circuit 620 fires.

However, as the pulse of current flows through the triggering circuit 620, the voltage across the capacitor C618 decreases. When the voltage across the capacitor C618, and thus, the second turn-on delay circuit 516, decreases to substantially the break-over voltage $V_{Z2}$ of the zener diode Z655, i.e., after the second turn-on delay time $t_{DELAY\text{-}ON2}$, the zener diode ceases to conduct current. As a result, the transistor Q660 becomes non-conductive causing the transistor Q650 to be rendered conductive and to conduct current through the SET coil of the DPDT latching relay 614. Accordingly, the DPDT latching relay 614 switches to position C and conducts the load current $I_{LOAD}$ from the AC power source 112 to the ballast 114. The length of the second turn-on delay time $t_{DELAY\text{-}ON2}$ is determined by the amount of time required to discharge the capacitor C618 from approximately the break-over voltage $V_{BR4}$ of the triggering circuit 620 (i.e., approximately 30V) to approximately the break-over voltage $V_{Z2}$ of the zener diode Z655 (i.e., approximately 18V). For example, the length of the second turn-on delay time $t_{DELAY\text{-}ON2}$ may be approximately 235 msec, but may range from approximately 100 msec to 250 msec.

When the SPDT switch 510 is changed from position A to position B, the switching circuit 500 stops conducting the load current $I_{LOAD}$ to the ballast 114 and the turn-off delay control current $I_{CON\text{-}OFF}$ begins to flow through the turn-off delay circuit 518. The turn-off delay circuit 518 is coupled to the RESET coil of the DPDT latching relay 614 and operates to cause the latching relay to change to position D. The turn-off delay circuit 518 comprises a diode D670, a timing circuit (e.g., a resistor R672 and a capacitor C674), and a triggering device (e.g., a diac 676). The turn-off delay control current $I_{CON\text{-}OFF}$ flows through the diode D670 and the resistor R672 to allow the capacitor C674 to charge. When the voltage across the capacitor C674 exceeds a break-over voltage of the diac 676, the diac conducts a pulse of current through the RESET coil of the DPDT latching relay 614, thus causing the latching relay to changes from position C to position D.

The length of the turn-off delay time $t_{DELAY\text{-}OFF}$, i.e., the time from when the SPDT switch 510 moves to position B to when the DPDT latching relay 614 moves to position D, is determined by the resistance of the resistor R672, the capacitance of the capacitor C674, and the break-over voltage $V_{BR4}$ of the diac 676. For example, the resistance of the resistor R672 may be approximately 60 kΩ, the capacitance of the capacitor C674 may be approximately 10 μF, and the break-over voltage $V_{BR4}$ of the diac 676 may be approximately 30 volts, such that the length of the turn-off delay time $t_{DELAY\text{-}OFF}$ may be approximately 100 msec.

This application is related to commonly-assigned, co-pending U.S. patent application Ser. No. 12/697,774, filed Feb. 1, 2010, entitled SWITCHING CIRCUIT HAVING DELAY FOR INRUSH CURRENT PROTECTION, the entire disclosure of which is hereby incorporated by reference.

Although the present invention has been described with reference to a lighting control system comprising a 0-10V control device and a 0-10V ballast, the switching circuit of the present invention may be used with any control device that is required to switch a load having a large inrush current. The switching circuit is not required to be used to control a 0-10V ballast, but could be used to control a ballast that receives a control input of a different type, for example, a phase-control signal or a digital communication link.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A two-wire switching circuit for controlling the power delivered from an AC power source to an electrical load, the switching circuit comprising:

a mechanical air-gap switch adapted to be coupled in series electrical connection between the AC power source and the electrical load;

a turn-on delay circuit adapted to be coupled in series electrical connection with the mechanical air-gap switch when the mechanical switch is in a first switch position, the turn-on delay circuit operable to conduct a control current through the mechanical air-gap switch when the mechanical switch is in the first switch position;

a controllably conductive device having a control input and coupled in parallel electrical connection with the turn-on delay circuit, the controllably conductive device adapted to be coupled in series electrical connection between the AC power source and the electrical load when the mechanical switch is in the first switch position, the controllably conductive device operable to change from a non-conductive state to a conductive state in response to the turn-on delay circuit after a first predetermined time from when the mechanical air-gap switch changes to the first switch position; and a latching circuit coupled to the turn-on delay circuit and the control input of the controllably conductive device, the latching circuit responsive to the turn-on delay circuit to control the controllably conductive device to the conductive state after the first predetermined time from when the mechanical air-gap switch changes to the first switch position, such that the controllably conductive device stays latched in the conductive state;

wherein the mechanical air-gap switch and the controllably conductive device are operable to conduct a load current from the AC power source to the electrical load when the mechanical air-gap switch is in the first switch position.

2. The switching circuit of claim 1, wherein the mechanical air-gap switch comprises a single-pole double-throw (SPDT) switch, the switching circuit further comprising:

a turn-off delay circuit operable to be coupled in series electrical connection between the AC power source and the electrical load when the mechanical air-gap switch is in a second switch position, the turn-off delay circuit operable to cause the latching circuit to control the controllably conductive device to the non-conductive state after a second predetermined time from when the mechanical air-gap switch changes to the second switch position.

3. The switching circuit of claim 2, wherein the latching circuit comprises a latching relay having a first coil and a second coil, the turn-on delay circuit coupled to the first coil to cause the latching relay to change to a first relay position, such that the controllably conductive device is controlled to the conductive state each half-cycle when the latching relay is in the first relay position, the turn-off delay circuit coupled to the second coil to cause the latching relay to change to a second relay position, such that the controllably conductive device is controlled to the non-conductive state each half-cycle when the latching relay is in the second relay position.

4. The switching circuit of claim 3, wherein the turn-on delay circuit comprises a first timing circuit, and a first triggering device coupled between the first timing circuit and the first coil of the latching relay, such that the first triggering device is responsive to the first timing circuit to cause the latching relay to change to the first position.

5. The switching circuit of claim 4, wherein the turn-off delay circuit comprises a second timing circuit, and a second triggering device coupled between the second timing circuit and the second coil of the latching relay, such that the second triggering device is responsive to the second timing circuit to cause the latching relay change to the second position.

6. The switching circuit of claim 5, wherein the turn-off delay circuit comprises a second resistor coupled to a second capacitor, the second resistor operable to conduct a second control current into the second capacitor to develop a second capacitor voltage across the second capacitor;

wherein the second triggering device comprises a second diac coupled between the second coil of the latching relay and the junction of the second resistor and the second capacitor; and wherein when the second capacitor voltage exceeds a break-over voltage of the second diac, the second diac conducts a gate current through the second coil of the latching relay.

7. The switching circuit of claim 4, wherein the turn-on delay circuit comprises a first resistor coupled to a first capacitor, the first resistor operable to conduct a first control current into the first capacitor to develop a first capacitor voltage across the first capacitor; and wherein the first triggering device comprises a first diac coupled between the first coil of the latching relay and the junction of the first resistor and the first capacitor;

wherein when the first capacitor voltage exceeds a break-over voltage of the first diac, the first diac conducts a gate current through the first coil of the latching relay.

8. The switching circuit of claim 3, wherein the latching relay comprises a double-pole double-throw (DPDT) latching relay.

9. The switching circuit of claim 8, wherein the DPDT latching relay is coupled to the turn-off delay circuit when the mechanical SPDT switch is in the second switch position and the DPDT latching relay is in the second relay position, a true air-gap break is provided between the AC power source and the electrical load.

10. The switching circuit of claim 9, wherein the DPDT latching relay comprises a first moveable contact and a second moveable contact;

wherein the first moveable contact is coupled to the control input of the controllably conductive device, such that when the moveable contact is in a first position, the controllably conductive device is controlled to the conductive state, and when the first moveable contact is in a second position, the controllably conductive device is controlled to the non-conductive state;

wherein the second moveable contact is operable to be coupled to the turn-off delay circuit, such that when the mechanical SPDT switch is in the second switch position and the second moveable contact of the latching relay is in a first position, the turn-off delay circuit is coupled in series electrical connection between the AC power source and the electrical load; and wherein when the mechanical SPDT switch is in the second switch position and the second moveable contact of the latching relay is in a second position, the true air-gap break is provided between the AC power source and the electrical load.

11. The switching circuit of claim 3, wherein the latching relay comprises a single-pole double-throw (SPDT) latching relay.

12. The switching circuit of claim 1, wherein the controllably conductive device comprises a bidirectional semiconductor switch.

13. The switching circuit of claim 1, wherein the first predetermined time is approximately 100 msec.

14. A two-wire switching circuit for controlling the power delivered from an AC power source to an electrical load, the switching circuit comprising:

a mechanical air-gap switch adapted to be coupled in series electrical connection between the AC power source and the electrical load;

a controllably conductive device having a control input, the controllably conductive device operable to be coupled in series electrical connection between the AC power source and the electrical load when the mechanical switch is in a first position;

a delay circuit coupled in parallel electrical connection with the controllably conductive device and in series electrical connection with the mechanical air-gap switch; and a latching circuit coupled to the control input of the controllably conductive device for controlling the controllably conductive device to be conductive, the latching circuit responsive to the delay circuit to control the controllably conductive device to be conductive after a first predetermined time from when the mechanical air-gap switch changes to the first position.

15. A two-wire switching circuit for controlling the power delivered to an electrical load from an AC source voltage of an AC power source, the switching circuit comprising:

a mechanical air-gap switch adapted to be coupled in series electrical connection between the AC power source and the electrical load;

a delay circuit coupled in series electrical connection with the mechanical air-gap switch when the mechanical switch is in a first position, the delay circuit operable to conduct a control current through the mechanical switch when the mechanical switch is in the first position; and a controllably conductive device having a control input and coupled in parallel electrical connection with the delay circuit, the controllably conductive device adapted to be coupled in series electrical connection between the AC power source and the electrical load when the mechanical switch is in the first position, the controllably conductive device operable to become conductive in response to the control current to conduct the load current through the mechanical switch when the mechanical switch is in the first position;

wherein when the mechanical air-gap switch is in the first position, substantially all of the AC source voltage is provided to the load.

16. A load control device for controlling the power delivered from an AC power source to an electrical load, the load control device comprising:

a mechanical air-gap switch adapted to be coupled in series electrical connection between the AC power source and the electrical load;

an actuator operable to actuate the mechanical air-gap switch;

a turn-on delay circuit adapted to be coupled in series electrical connection with the mechanical air-gap switch when the mechanical switch is in a first position, the turn-on delay circuit operable to conduct a control current through the mechanical air-gap switch when the mechanical switch is in the first position;

a controllably conductive device having a control input and coupled in parallel electrical connection with the turn-on delay circuit, the controllably conductive device adapted to be coupled in series electrical connection between the AC power source and the electrical load when the mechanical switch is in the first position, the controllably conductive device operable to change from a non-conductive state to a conductive state in response to the turn-on delay circuit after a first predetermined time from when the mechanical air-gap switch changes to the first position; and a latching circuit coupled to the turn-on delay circuit and the control input of the controllably conductive device, the latching circuit responsive to the turn-on delay circuit to control the controllably conductive device to the conductive state after the first predetermined time from when the mechanical air-gap switch changes to the first position, such that the controllably conductive device stays latched in the conductive state;

wherein the mechanical air-gap switch and the first controllably conductive device are operable to conduct the load current when in the first position.

17. The load control device of claim 16, wherein the mechanical air-gap switch comprises a single-pole double-throw (SPDT) switch, the load control device further comprising:

a turn-off delay circuit operable to be coupled in series electrical connection between the AC power source and the electrical load when the mechanical air-gap switch is in a second position, the turn-off delay circuit operable to cause the latching circuit to control the controllably conductive device to be non-conductive after a second predetermined time from when the mechanical air-gap switch changes to the second position.

18. The load control device of claim 17, wherein the latching circuit comprises a latching relay having a first coil and a second coil, the turn-on delay circuit coupled to the first coil to cause the latching relay to change to a first position, such that the controllably conductive device is controlled to the conductive state each half-cycle when the latching relay is in the first position, the turn-off delay circuit coupled to the second coil to cause the latching relay to change to a second position, such that the controllably conductive device is controlled to the non-conductive state each half-cycle when the latching relay is in the second position.

19. The load control device circuit of claim 18, wherein the latching relay comprises a double-pole double-throw (DPDT) latching relay further coupled to the turn-off delay circuit, such that when the mechanical SPDT switch is in the second position and the DPDT latching relay is in the second position, a true air-gap break is provided between the AC power source and the electrical load.

20. The load control device of claim 16, further comprising:

an intensity adjustment actuator; and a control circuit adapted to be coupled to the electrical load and operable to generate an intensity control signal in response to the intensity adjustment actuator.

21. The load control device of claim 20, wherein the control circuit comprises a 0-10V control circuit.

22. The load control device of claim 16, wherein the controllably conductive device comprises a bidirectional semiconductor switch.

23. A method for controlling the power delivered to an electrical load from an AC power source, the method comprising:

switching a mechanical switch to a first position;

beginning to conduct a control current through the mechanical switch in response to switching the mechanical switch to the first position;

coupling a first controllably conductive device in series electrical connection between the AC power source and the electrical load when the mechanical switch is in the first position;

controlling the first controllably conductive device to a conductive state after a first predetermined time from the beginning of the conduction of the control current through the mechanical switch;

subsequently conducting a load current through the mechanical switch; and latching the first controllably conductive device in the conductive state such that the first controllably conductive device is subsequently maintained conductive each half-cycle of the AC power source.

24. The method of claim 23, further comprising:

switching the mechanical switch to a second position; and controlling the first controllably conductive device to a non-conductive state after a second predetermined time from when the mechanical switch is switched to the second position.

25. The method of claim 24, further comprising the step of:

providing a true air-gap break between the AC power source and the load after the mechanical switch is switched to the second position.

* * * * *